US005340199A

United States Patent [19]

Piefenbrink et al.

[11] Patent Number: 5,340,199

[45] Date of Patent: Aug. 23, 1994

[54] METHOD AND MACHINE FOR EXCAVATING DRIFTS, TUNNELS, STOPES, CAVERNS OR THE LIKE

[75] Inventors: Wilfried Piefenbrink, Erkelenz; Walter Weber, Aachen, both of Fed. Rep. of Germany; Hermann Hamburger, Geneva, Ill.

[73] Assignees: HDRK Mining Research Limited, Oakville, Canada; Wirth Maschinen-und Bohrgerate-Fabrik GmbH, Erkelenz, Fed. Rep. of Germany

[21] Appl. No.: 946,338

[22] PCT Filed: Apr. 29, 1991

[86] PCT No.: PCT/EP91/00814

§ 371 Date: Nov. 6, 1992

§ 102(e) Date: Nov. 6, 1992

[87] PCT Pub. No.: WO91/18185

PCT Pub. Date: Nov. 28, 1991

[51] Int. Cl.[5] ..... E21C 25/16; E21D 9/10

[52] U.S. Cl. ..... 299/10; 299/33; 299/71

[58] Field of Search ..... 299/33, 57, 61, 63, 299/71, 10; 405/138

[56] References Cited

U.S. PATENT DOCUMENTS

| | | | |
|---|---|---|---|
| 1,806,792 | 5/1931 | Degenhardt et al. | 299/61 X |
| 3,695,717 | 10/1972 | Birrer | 299/71 X |
| 3,814,481 | 6/1974 | Montacie | 299/61 |
| 4,248,481 | 2/1981 | Stoltefuss | 299/61 X |
| 4,805,963 | 2/1989 | Kogler et al. | 299/33 |

FOREIGN PATENT DOCUMENTS

| | | |
|---|---|---|
| 2108444 | 9/1972 | Fed. Rep. of Germany . |
| 7801600 | 5/1978 | Fed. Rep. of Germany . |
| 3140707 | 4/1983 | Fed. Rep. of Germany . |
| 8717189 | 5/1988 | Fed. Rep. of Germany . |
| 2241687 | 3/1975 | France . |

OTHER PUBLICATIONS

Handbook of Mining and Tunnelling Machinery by B. Stock, pp. 285–293, 1982.

*Primary Examiner*—David J. Bagnell
*Attorney, Agent, or Firm*—Edward A. Steen

[57] ABSTRACT

To excavate drifts, tunnels, stopes, caverns or the like, tools operating in an undercutting manner are mounted on radially pivotable tool arms, which are located on a rotary working head. With at least one tool (54) on a tool arm (51), a central region (Z) of the rock face is cut radially from the outside inwards by pivoting of the tool arm (32), an outer region (A) surrounding the central region (Z) of the rock face is cut radially from the inside outwards by pivoting of the tool arm (32). Pivot drives (30) for at least some tool arms (31, 32, 33) can be controlled in such a manner that cross-sections with contours deviating from a full circular shape can be cut. Muck removing devices (27, 28) are used for collecting and transporting away the muck produced by the cutting operation.

22 Claims, 5 Drawing Sheets

METHOD AND MACHINE FOR EXCAVATING DRIFTS, TUNNELS, STOPES, CAVERNS OR THE LIKE

BACKGROUND OF THE INVENTION

1. Field of the Invention

This invention relates to a method for excavating drifts, tunnels, stopes, caverns and the like with tools such as disc cutters, operating in an undercutting manner on a rock face, and a machine for performing such excavation.

2. Description of the Prior Art

Undercutting disc cutters working from a pilot bore-hole or opening are known as an effective cutting system, since in such a case, it is not the high compressive strength of the rock which must be overcome, but rather only its low tensile strength. A tunnelling machine with a rotary head is known (DE 31 40 707 A1), which has a pilot borer located on the front of the head working in a conventional manner (i.e. using a conventional drilling head) and spaced behind it in the axial direction, a plurality of tool supports are provided which are formed as radially pivotable arms. Disc cutters mounted on these arms start from a centrally located pilot hole in order to cut the rock in an undercutting manner with a radial pivoting-out motion of the arms. To cut the pilot hole with a relatively large diameter using a conventional drilling head requires a great deal of effort and is difficult to achieve concurrently with the operation of the disc cutters working in the undercutting mode. It is also considered disadvantageous that the pilot bore-hole drilling process requires high thrust.

In another known tunnelling machine (DE 87 17 189 U1), two pivotable supporting arms equipped with disc cutters are mounted parallel to one another on a rotary head in such a manner that they are located on either side of a diameter line of the head. The pivot points of the supporting arms are located on the periphery of the head, in such a manner that the supporting arms face one another. Instead of drilling a pilot hole, in this case each of the two disc cutters makes a start on the rock at a point lying on the far side of the central line which corresponds to the axis of rotation of the head, with respect to the pivot point of the associated supporting arm, and then moves along the path of pivoting of the arm beyond this central line and continues out to the perimeter of the opening. This means that each disc cutter is subject to very different conditions during the course of the pivoting movement of its supporting arm. In particular, each disc cutter starts a small distance from the central line, this distance decreasing until the central line has been crossed. Following this, the disc cutter is still operating in the vicinity of the central cutting area. As will be explained later, this is inefficient. Moreover, the machine is restricted to the use of only two disc cutters.

BRIEF SUMMARY OF THE INVENTION

The object of the present invention is to provide a method of excavating drifts, tunnels, stopes, caverns or the like using the undercutting principle, but without the necessity for a predrilled pilot opening, produced separately using a conventional drilling head. According to this invention an effective cutting of the rock face is possible under favourable conditions for the tools using solely the undercutting principle. Furthermore, a larger number of tools than two can be used. In addition to the method, the invention is intended to create a machine which is particularly suitable for carrying out the method and with which drifts, tunnels or the like can be excavated with favourable operating conditions for the tools. The invention also aims to provide, in particular, an advantageous embodiment of such a machine. Further advantages of this invention are discussed in the description given below.

The invention proposes that with at least one tool mounted on a pivotable tool arm which itself is mounted on a rotating head of the machine, a central region of the rock face is cut radially from the outside inwards by pivoting the tool arm, and with at least one other tool mounted on at least one other pivotable tool arm carrying said tool, an outer region surrounding the central region of the rock face is cut radially from the inside outwards by pivoting the said other tool arm. The cross-section obtained thereby may be the final profile or an intermediate profile.

Such a method makes it possible to excavate a drift or the like advantageously and with particularly favourable and effective operating conditions for the tools without using a conventional drilling head to pre-excavate a pilot hole and while operating entirely according to the undercutting principle. The invention takes into account that disc cutters or similar tools operating in an undercutting manner will not perform satisfactorily under certain conditions, under which they are subject to unfavourable effects and heavy wear. This is especially the case if all disc cutters are to operate under radial motion with the cutter arm pivoting from the inside outwards, particularly if the excavation radius is smaller than the radius of the excavating disc cutter itself. The "excavation radius" is intended to mean the distance between the respective starting point of the disc on the rock face and the reference axis, i.e. the axis of rotation of the head. These problems are not present in the method according to this invention. Rather, in this case the disc cutters used can operate advantageously with regard to excavating performance, stress and wear, because of their positioning on the tool arms and the direction in which each tool arm is pivoted.

The central region of the rock face is normally defined by a circle. An outer region surrounding the central region may also be circular in projection if a circular drift profile is desired. However, other profiles of the outer region can also be produced.

A tool or tools positioned for cutting the central region of the rock face and a tool or tools positioned for cutting an outer region at the start of the respective cutting cycle may start at radially different points, in such a manner that the cut areas overlap, or the tools may start at a substantially equal distance from the reference axis. In this respect, there are several possibilities for carrying out the method within the scope of this invention. Furthermore, it may be advantageous to apply to the rock face at least one tool for the central region and at least one tool for the outer region simultaneously and then to pivot the tool arms radially in opposite directions. In another embodiment of the method according to the invention, the tools concerned are applied to the rock face at different times at the start of each cutting cycle.

Different radial proportions between the central region and an outer region can be chosen according to the conditions and requirements. Advantageously, when excavating an approximately circular cross-section, the ratio of the radial extension of the central region of the rock face to the maximum radial extension of the outer region thereof may be chosen so as to correspond at least approximately to the ratio of the number of tools working in the central region to the number of tools working in the outer region. When a circular profile is being excavated, there is a virtually free choice not only in size of the central region and size of the outer region, but also in the number of tools for each region. In particular, for a circular profile, the central region is chosen as large as possible with a correspondingly large number of tools to cut the same.

Within the scope of the method of this invention, by controlling the movements of the tool arms, drifts or stopes with different cross-sectional shapes and sizes may be produced. An outer region surrounding the central region of the rock face may receive a noncircular cross-sectional shape either immediately from the tools cutting it, or may be shaped subsequently to a desired noncircular cross-section, after an initial circular cross-section has been cut.

It is advantageous in fact that, at first, during cutting of at least a part of the central region of the rock face and of an outer region surrounding the latter, a substantially circular cross-sectional outline is cut, and thereafter a cross-sectional profile deviating from the circular is cut. If the central region has not been fully cut at the start of the stage last mentioned, which may be advantageous in some cases, the rest of the central region may be cut while the outer profile deviating from the circular is cut.

To cut the central region and to cut an outer region, within the scope of the method of this invention, an even number of tools can be used in each case, either one tool for each region or two tools for each region, or more. However, when cutting a cross-sectional profile deviating from the circular, in an advantageous embodiment of this invention, the number of tools cutting the outer region is chosen to be larger than the number of tools for the central region of the rock face. This is advantageous with regard to the power used for the excavation or respectively provided by the tunnelling machine.

A machine of the type mentioned, which is particularly suitable for carrying out the method described, has a head which is rotatable and movable in the direction of excavation, on which head tool arms are mounted which are radially pivotable by drives relative to a reference axis forming the axis of rotation of the head, the tool arms having tool supports for tools, such as disc cutters, operating in a undercutting manner, wherein for cutting an outer region of the rock face, surrounding a central region, at least one tool arm is pivotable from a starting position in which the tool is located on an engagement point lying between the reference axis and the outer circumference of the rock face, outwards to a position in which its tool is located at the outer circumference of the rock face, the machine being characterized in that for cutting a central region of the rock face, at least one tool arm is pivotable from a starting position, in which its tool is located on an engagement point lying between the reference axis and the outer circumference of the rock face, inwards to a final position in which its tool is located on or near the reference axis.

Such a machine does not require a predrilling pilot borer, but has only radially pivotable tool arms. This machine is able to cut a rock face advantageously in different regions with tools associated with these regions and under particularly advantageous conditions for the tools. It can operate with two, but in particular with more than two tools, and in principle each tool arm is provided with at least one tool, such as a disc cutter. The number of tool arms with tools can be chosen for each region to be worked according to the circumstances. In the case of a circular profile, the choice here is substantially open, so that very varied requirements can be met.

To cut an outer region of the rock face, an even or an odd number of tool arms can be provided, either in a regular arrangement, i.e. with equal angular intervals in the circumferential direction, or with angular intervals which differ from one another. It can be decided according to the desired profile shape what is advantageous in each case. In particular, the number of tools operating in the outer region and/or their angular spacing in the circumferential direction are chosen to suit the profile shape with regard to a highly efficient use of the power provided and/or with regard to advantageous load conditions of the machine parts involved. The latter applies especially to the load on the mounting of a rotatably drivable part supporting the tool arms, such as the head of the machine or the like.

An odd number of tool arms is advantageous particularly when cutting an approximately square profile and other profiles which are symmetrical in two dimensions or have two axes of symmetry.

In a preferred embodiment for this type of profile one tool arm is associated with the central region, whereas three tool arms with equal angular spacing from each other are provided for an outer region. The torque required for cutting the corners with the machine according to this preferred embodiment of the invention is only about 1.33 times the torque required by one arm, whereas a machine with two arms at an angular spacing of 180 degrees requires around twice the torque, and a machine with 4 arms at 90 degrees spacing needs almost the quadruple torque.

If external factors demand two arms for the outer region, then these should have an angular spacing which is other than 180°, in particular approximately 135° (225°). In the case of four arms, the embodiment should, in particular, be so arranged that the angular spacing between each pair of arms is 45° and 135° respectively. But the angular spacing may also be, for example, 60° and 120°. In the case of five arms, as in the case of three arms, an equal angular spacing, i.e. a regular arrangement of the arms, would be advantageous.

In a profile with an approximately triangular basic shape, two arms may be provided which are offset relative to one another by 180° or which together include an angle of 60° (300°). In the case of three arms, these are most suitably arranged so that two arms include an angle of approximately 60° and the two other angles have the same size of approximately 150°. In the case of four arms, a regular arrangement with angular spacings of 90° or an arrangement with angular spacings of respectively 45° and 135° between each two arms may be particularly advantageous.

If what is known as a horseshoe profile or similar shape is to be cut, an even number of arms may be advantageous, i.e. two arms offset relative to one another by 180°. According to the particular contour of the profile to be cut, three arms arranged with equal angular spacings may also be advantageous. Also, more than three arms may be provided.

In the case of cutting an elliptical or similar profile, two arms may be used, which are at an angle of 90° relative to one another. This is advantageous with regard to efficient use of the power provided by the machine, but less so with regard to an even load on the head bearing. For this profile, furthermore, three arms with equal angular spacings are possible, but the number of arms chosen may also be even larger if desired.

All the above-mentioned embodiments with their features and modifications are part of the present invention.

All available tool arms can be mounted on a single driven rotatable head. However, it may also be advantageous to provide at least one tool arm for cutting the central region of the rock face and at least one tool arm for cutting an outer region of the rock face on separate heads which are rotatable about a common axis. This provides the possibility, for example, of selecting in a particularly advantageous manner the tool-cutting parameters for the central region and for an outer region, by operating the two heads at different speeds.

The pivotal axis of at least one tool arm with a tool for cutting the central region of the rock face may be located on or near the reference axis, or have a positive or negative radial distance from the reference axis. These options make it possible to meet various circumstances or conditions in a particularly advantageous manner.

Devices for pivoting the tool arms are most suitably controlled in such a manner that both the degree and speed of movement can be selected as required. Control may in particular involve changing the pivotal angle to produce a radial path change of the tool and/or changing the force of displacement acting on the tool arm or tool respectively, in each case with reference to the rotation of the head. The operation can be readily adapted to the properties of the rock.

Regardless of any particular embodiment of this invention, hydraulic or pneumatic devices are most suitable as pivot drives for the tool arms. In particular, cylinder-piston units are suitable, but other drive or movement units are not excluded.

The pivot drives for the tool arm or arms for cutting the central region of the rock face and for the tool arm or arms for cutting the outer region thereof may be controlled together, but are also most suitably controlled independent of one another, so that the conditions in each case can be particularly well met. At least one pivot drive for at least one tool arm can be controlled in such a manner that cross-sections with a contour deviating from a full circle can be cut with its tool.

Pivot drives for the tool arms can, in each case, be controlled manually depending on the onset of specifiable conditions or until specified positions have been reached, or automatically according to a predetermined program.

The pivotal angle change imparted to the respective tool arm per revolution results in the radial forward motion of the tool. It is assumed in principle that each tool arm is provided only with one tool or disc cutter. The radial working forward motion, and hence the penetration of the tool, may remain constant throughout a cutting cycle or may be varied by appropriate control of the pivot drive. It may be of special advantage, in particular when cutting the central region, to increase the radial forward speed per revolution during the process. When cutting the central region, the tool arm pivots radially inwards. In this case, with each revolution, the contact area of the disc cutter with the rock becomes smaller, so that with the same thrust the penetration is increased.

When cutting a noncircular cross-section a radial forward motion is imparted to the tool arm concerned, which changes throughout the rotation of the head in such a manner that the required penetration for generating the desired final profile is achieved.

In an advantageous embodiment, the machine has a part which may be tensioned or gripped in the drift already excavated and a part which is displaceable relative thereto and which supports the head. Advantageously, this may be an arrangement with a so-called inner kelly and a so-called outer kelly, similar to those in a conventional TBM (Tunnel Boring Machine).

The part which is gripped in the drift may in particular be capable of being braced both in the vertical and in the horizontal directions. Thereby, the machine is suitable for very varied applications, for example, as a so-called miner machine.

The advance movement or forward feed of the machine may be effected by means of a set of walking legs which may be formed, for instance, by parts of a bracing device. In another embodiment, the machine has a chassis, in particular a crawler chassis.

In the case of at least some of the tool arms, their tool supports can be mounted adjustably on the tool arms. This applies to linear as well as to angular adjustability. In particular, the tool arms can be lengthened and shortened telescopically or have displaceable parts carrying the tool supports. In another embodiment, .the tool supports are mounted on the tool arms so as to be able to pivot sufficiently in order that a desired cutting angle can be set. Furthermore, the tool arms operating in the outer region may be used to assist removal of the rock cuttings, known as muck, produced by the machine. These tool arms can be fitted with devices that will help move the muck into the muck removal system.

Further details, features and advantages of the invention will become clear from the following explanation of embodiments, from the associated drawings and from the claims.

DETAILED DESCRIPTION

Figure 1:
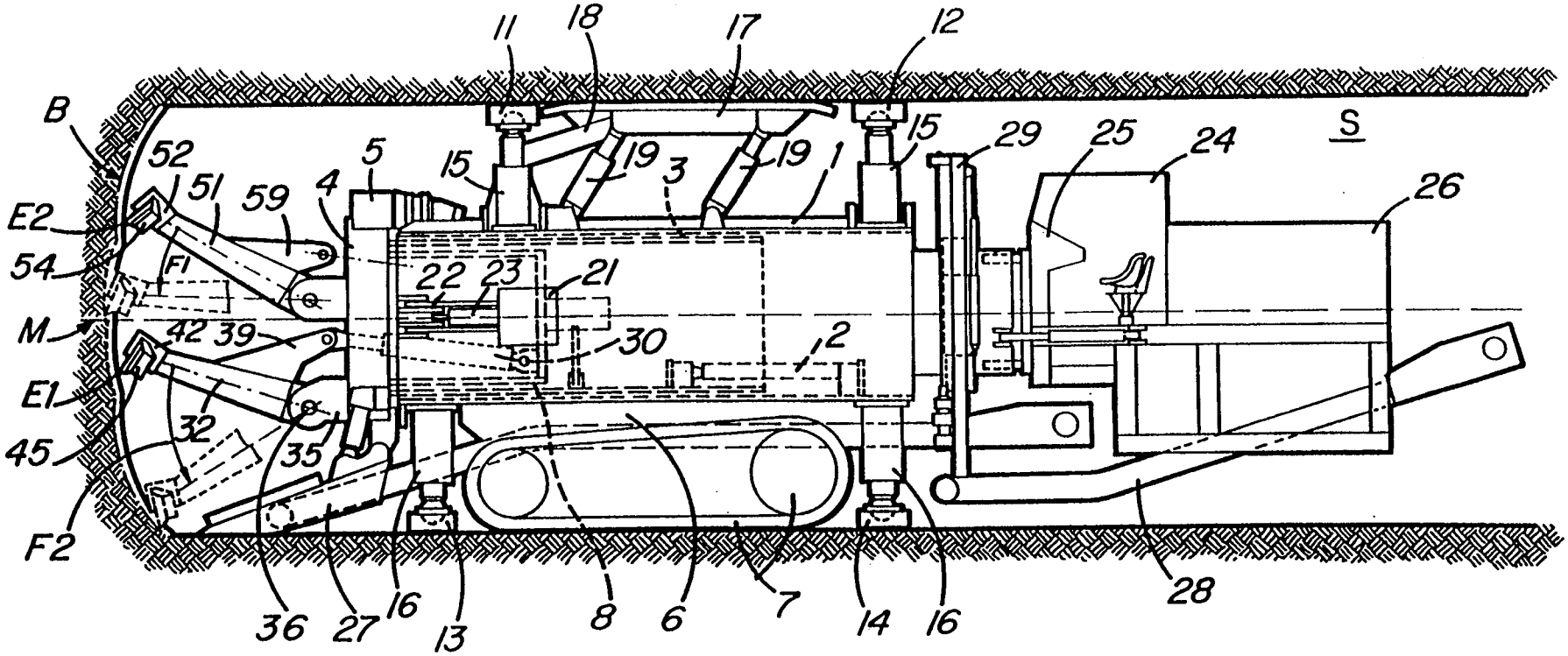
FIG. 1, shows an embodiment of the machine according to the present invention in a side view.
Figure 2:
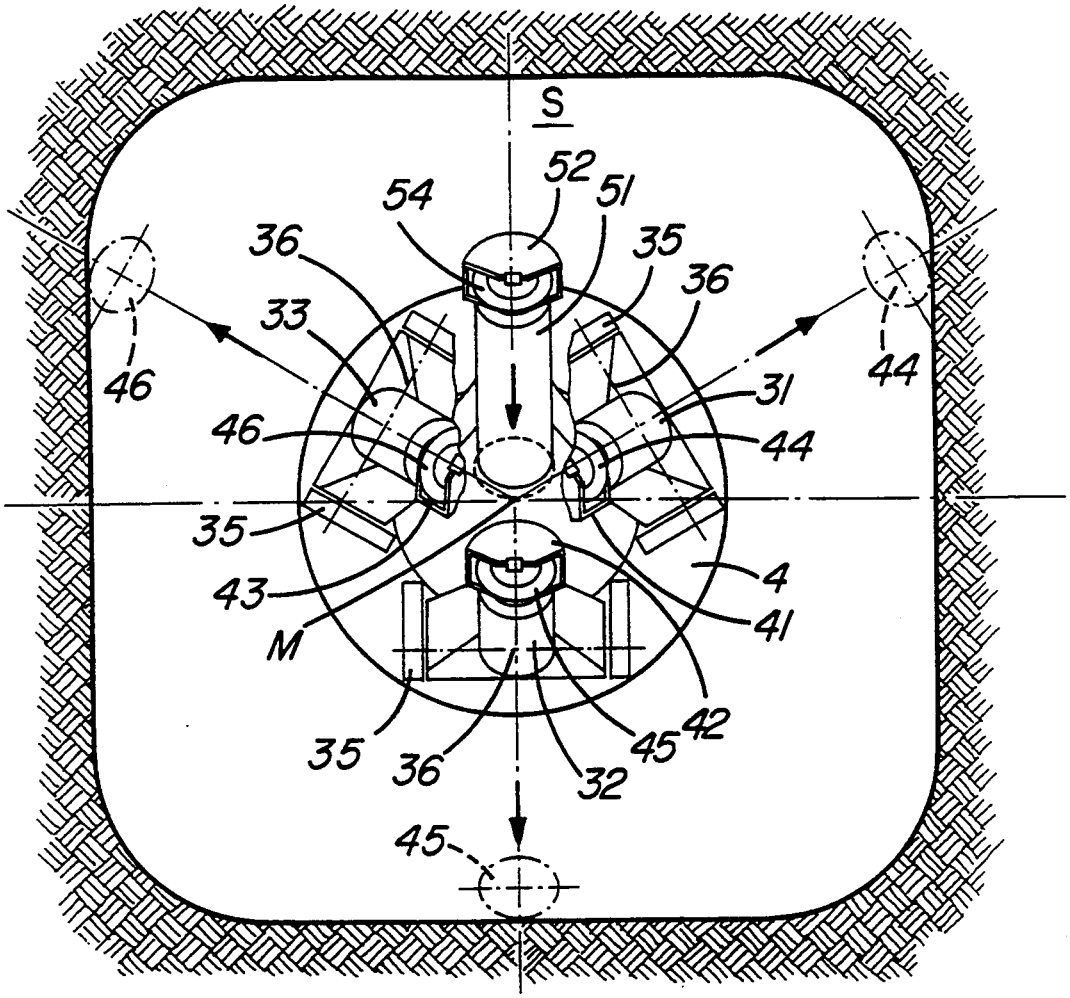
FIG. 2, shows a simplified front end view of the machine of FIG. 1.

The tunnelling machine shown in FIGS. 1 and 2 has an outer body 1 and an inner body 3 guided displaceably therein by means of cylinder-piston units 2. On the front end of the inner body 3, a head 4 is rotatably mounted. A motor 5 is provided, which is for example hydraulic, as a rotary drive for the head 4. A plurality of such motors may be provided. The letter M indicates a reference axis, which extends in the direction of advance and is in particular equal to the longitudinal axis of the machine or the axis of rotation of the head 4 respectively.

The outer body 1 is carried together with a base frame 6 by a crawler chassis 7 and is equipped with a device for vertically bracing against the floor and the roof of the drift S. This device comprises a pair of front upper gripper devices 11, a pair of rear upper gripper devices 12, a pair of front lower gripper devices 13 and a pair of rear lower gripper devices 14. These gripper devices can be raised and lowered by upper and lower hydraulic cylinder-piston units 15 and 16 and can be gripped against the walls of the drift. In addition, a roof shield 17 is mounted on the top of the outer body 1, said shield is connected to the outer body 1 by coupling bars 18 and cylinder-piston units 19 and can be placed against the roof of the drift to protect the machine from falling rock. Such shield can also be provided in the front of the machine if desired.

An outrigger 21 is mounted on each side of the outer body 1 and is pivotably connected to the outer body by jointplates 22 and can be pushed against the side wall of the drift by a cylinder-piston unit 23. These outriggers 21 provide lateral stability for the machine. Several such outriggers could be provided on each side.

According to the circumstances, it may also be advantageous to provide, instead of such stabilising outriggers, other devices for rigidly bracing the outer body 1 against the side wall of the drift in the horizontal direction, for example, similar to the devices 11 to 16 used for vertical bracing. An embodiment is also included which has only one device for horizontal bracing and optional parts for providing stability in the vertical direction. Separate stabilizers can also be provided for the gear box driving the head 4 of the machine in order to reduce vibration of the head.

The gripper devices 11, 12, 13, 14 of the bracing device are suitably matched to the drift profile. Instead of such gripper devices, clamping shields or the like can be provided.

The machine in the embodiment shown, also has, inter alia, the following parts: a cabin 24 for the operator with a control panel 25; an aggregate 26 with supply and/or drive units; muck removing devices 27, 28 for collecting and transporting away the muck, and an anchor hole drill 29 to provide rock support. Further means for providing rock support as well as other supplementary devices can be fitted on the machine as required.

Figure 3:
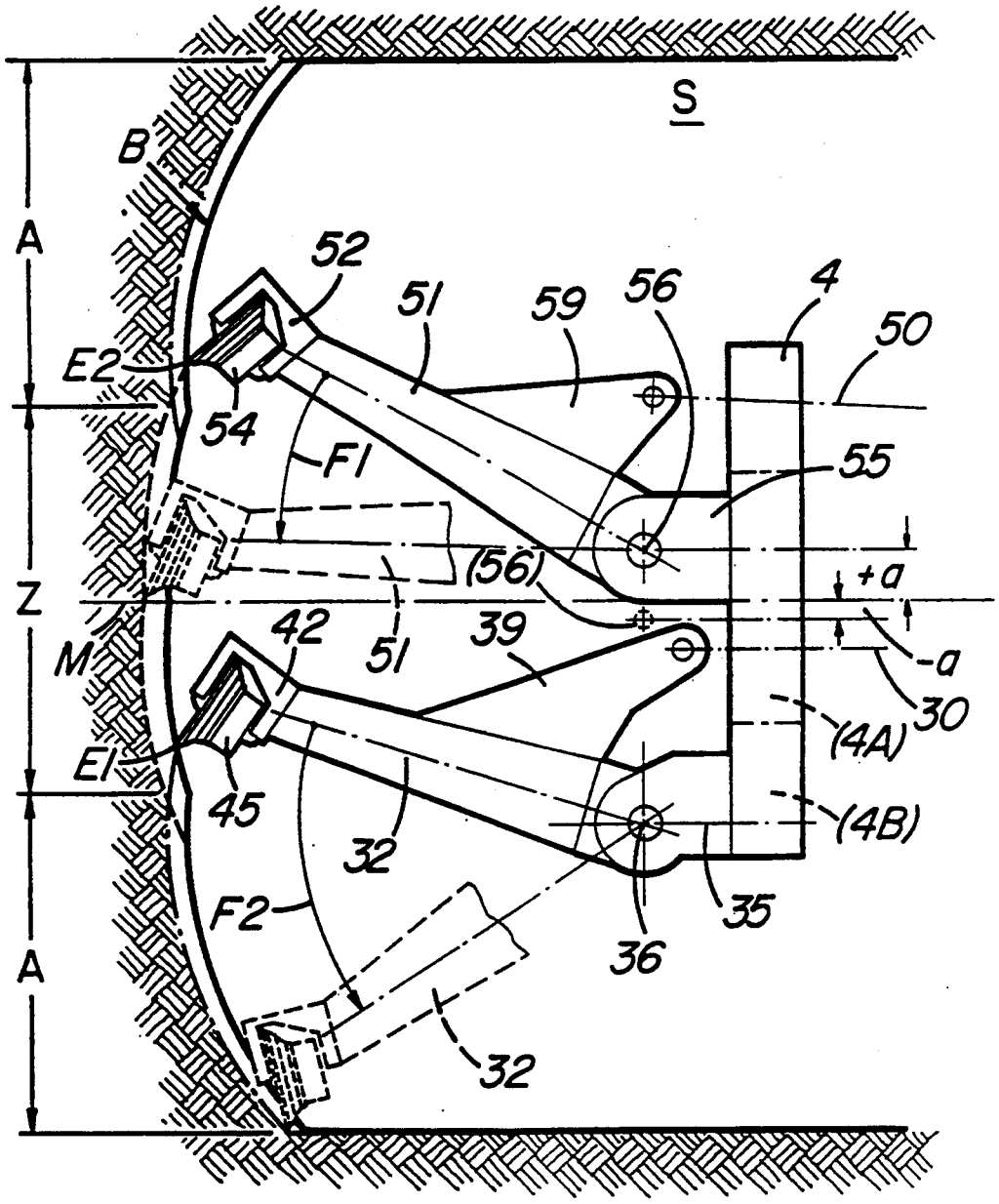
FIG. 3 shows a partly diagrammatic side view of a head with tool arms in two different positions thereof.

As shown in FIG. 2 in particular, three tool arms 31, 32 and 33 are provided on the head 4 at equal angular distance from one another and each having a tool support 41, 42 and 43 holding a disc cutter 44, 45 and 46 suitable for undercutting operations. Each tool arm 31, 32 and 33 .is mounted in a bracket 35 mounted on the front of the head 4, in such a manner that the tool arm can pivot about an axis 36 in a radial plane. For this purpose, a cylinder-piston unit 30 (FIG. 1) is provided for each tool arm, which is coupled by its rear cylinder end to a tubular part 8 of the head 4 extending into the inner body 3. The piston rod end in each unit 30 is connected to a cantilever 39 of the respective tool arm by a pivot joint or the like. In FIG. 3 and a few other figures, the pivot drives 30 are only indicated by dot-dash lines, which can be construed as being centre lines of the piston rods of the units.

The pivot drives 30 for the tool arms can be actuated both individually or together, in which case the control can be carried out manually or automatically depending on predetermined conditions, or wholly or partly according to a computer program.

Regarding the tool arms 31, 32, 33, FIGS. 1 , 3, 5, 7, 9 and 11 show only the tool arm 32 in each case, for the sake of clarity of the drawing.

Figure 5:
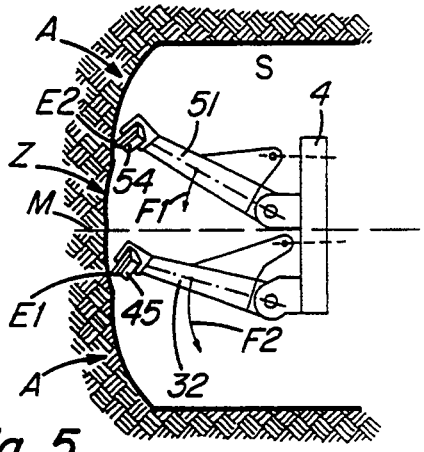

The arrangement is such that all three tool arms 31, 32, 33 can assume a starting position for the operation, in which the tools 44, 45, 46 are located on an engagement point E1 located between the reference axis M and the outer circumference of the drift. This starting position is shown in FIGS. 1 and 3 in full lines, and is also shown in FIG. 5. The tool arms 31, 32, 33 can be pivoted out of this starting position into their respective final position to form the desired drift profile. This is shown in FIGS. 1 and 3 with broken lines and further shown in FIGS. 7 and 11 respectively.

In addition to the tool arms 31, 32, 33, in the embodiment illustrated, a further pivotable tool arm 51 is present, which—viewed in the circumferential direction—is mounted between the tool arms 31 and 33 (FIG. 2). Its mounting is in principle .similar to that of the other tool arms, i.e. it is mounted on a bracket 55 (FIG. 3) fixed to the working head 4 in such a manner that it can be pivoted in a radial plane about an axis 56. As a pivot drive, in this case also a cylinder-piston unit 50 is provided, which engages with a cantilever 59 of the arm 51 and which may substantially correspond to the pivot drives 30. The unit 50 is indicated in the drawings only by a dot-dash line in the path of the piston rod axis. This pivot drive is controllable independently of the pivot drives 30 for the other tool arms, either manually, or as a sequence control, according to a pre-set program or in another suitable manner.

The tool arm 51 has a tool support 52 with a disc cutter 54. The form of these parts may correspond to that of the other tool arms 31, 32, 33.

The pivotal axis 56 of the tool arm 51 may be arranged in different manners relative to the reference axis M, depending on conditions. In the embodiment shown, the pivotal axis 56 has a positive distance +a from the reference axis M (FIG. 3), but it may also lie on the reference axis M, i.e. approximately in the centre of the head 4. Finally, the pivotal axis may be positioned below the reference axis M, which shall be indicated here as a negative distance −a (FIG. 3). In the choice of position of the pivotal axis 56, various criteria may be decisive, among them being those of transport dimensions or transport conditions of the machine.

The tool arm 51 can be pivoted out of a starting position, in which its tool 54 is located on an engagement point E2 between the reference axis M and the outer circumference of the drift, radially inwards until it reaches a position in which the associated tool 54 is located near or on the reference axis M, as is indicated with broken lines in FIGS. 1 and.3.

The operation of the machine will now be described below according to a particular method, while referring to the appended drawings.

Figure 4:
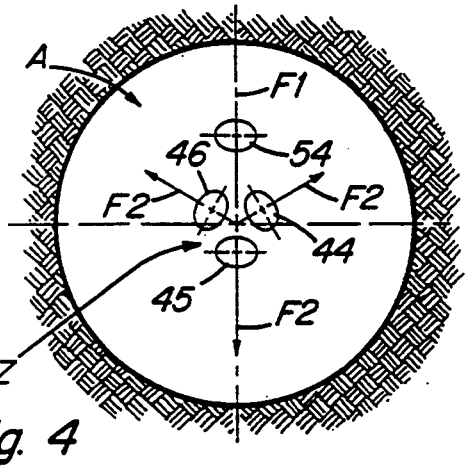
FIGS. 4 to 11, show partly diagrammatic representations of various stages of operation, respectively a plan view of the rock face and a corresponding side view of the head, the side views showing only one tool arm each for the outer region for the sake of clarity

The starting position for a cutting cycle can be seen with the engagement points E1 and E2 from the solid lines in FIGS. 1 to 3, and from FIGS. 4 and 5.

The tool 54 on the tool arm 51 is for cutting an approximately circular central part of the rock face B indicated as a central region Z, whereas the tools 44, 45, 46 on the tool arms 31, 32, 33 are intended for cutting an outer region A surrounding the central region Z. The latter is approximately circular when driving a drift with a circular profile, but when generating other profiles, it may also have another shape.

During the rotation of the head 4, the tool arm 51 is pivoted gradually radially inwards from the starting position as previously mentioned, by means of its pivot drive 50, in the direction of the arrow F1. During this, its tool 54 cuts the central region Z of the rock face B from the outside inwards. The radial forward advance determined by the change in the pivotal angle per revolution of the head can remain constant during the cutting cycle, or it may be altered, in particular increased. This is favoured by the fact that with each revolution the contact area under the disc cutter is reduced, so that at the same thrust, the penetration is increased.

Simultaneously with the start of operation of tool 54 or optionally with a time lag, a pivoting movement in the direction of the arrows F2 radially from the inside outwards, is imparted to the tool arms 31, 32, and 33 by means of the drives 30, so that the tools 44, 45 and 46 start to cut the outer region A from their respective engagement points El.

Figure 6:
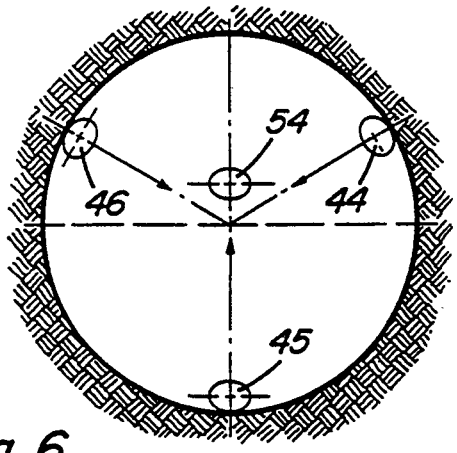
Figure 7:
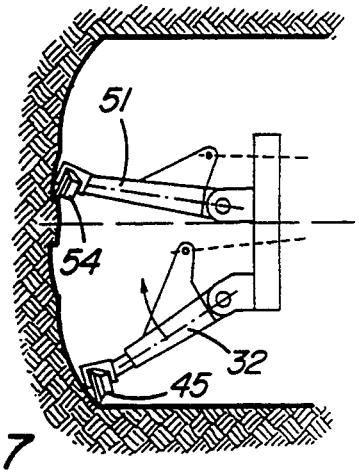

In FIGS. 6 and 7, the tool arms 31, 32 and 33 have reached their outer final positions for this operation, and the tools 44, 45 and 46 have reached the outer diameter of the drift and have cut a circular cross-section (see also the final position of the arm 32 shown with a broken line in FIG. 3).

During this process, the tool arm 51 may have reached its final inner position, as is shown in FIG. 3 by a broken line, so that the tool 54 has therefore cut the whole central region Z. This is an advantageous way to proceed if only a circular cross-section is to be cut.

Figure 10:
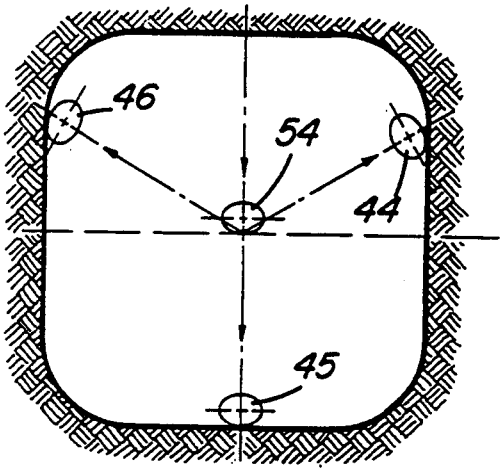

When cutting a noncircular drift profile, for example, an approximately square profile with rounded corners according to FIG. 2 and FIG. 10, this may be effected, for example, by first cutting a profile with a circular outline and then cutting the parts which deviate from the circle and/or extend beyond it.

Figure 11:
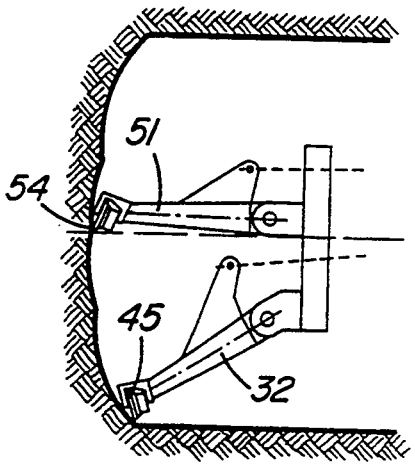

This may be effected as a continuation of the operation hitherto, in which the arms 31, 32 and 33 cut a profile of approximately square basic shape with rounded corners, as FIG. 10 shows. The tool arms are, in this case, controlled with regard to radial path and/or thrust, so that the different penetrations, required during a rotation of the head result, in order to produce the desired profile. The final position of the arms is shown in FIG. 11.

Figure 8:
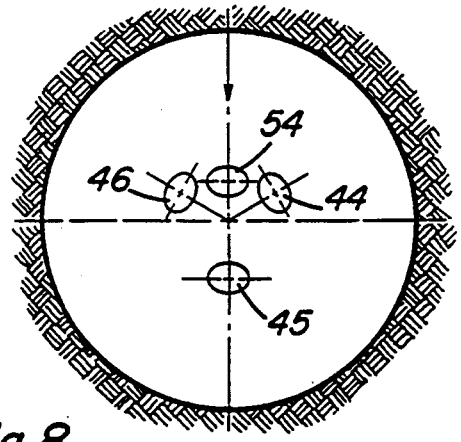
Figure 9:
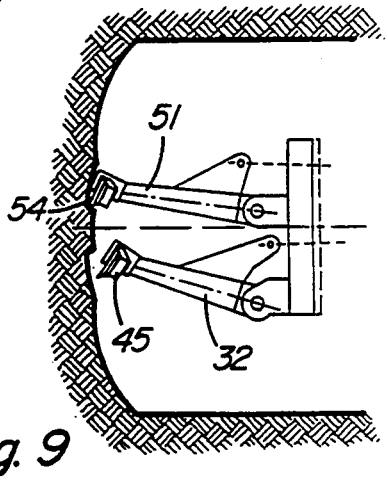

If cutting of the central region Z is still not complete when the arms 31, 32, 33 have already generated the final contour, it is also possible to proceed so that the arms 31, 32, 33 are moved into inactive position, until the central region Z has been completely cut. Such a position of the arms is shown in FIGS. 8 and 9. This can be achieved in particular by moving the head 4 slightly, as the broken line in FIG. 9 indicates. This prevents the tools from remaining in contact with the rock face when the arms are pivoted inwards. The tool 54 on the arm 51 continues its work. Such retraction of the head could also be Useful in some other aspects of the cutting operation.

It is also possible to mount the tools, or their supports respectively, adjustably on the arms 31, 32, 33, in such a manner that the tool supports can be moved by varying degrees relative to the arms. This is indicated in FIG. 7 on the arm 32. When it is desired or necessary to move the arms 31, 32, 33 into a inactive position before cutting a non-circular cross-section, this can be achieved by slightly retracting the tool supports, without the need to move the head axially in this case. An embodiment of an adjustable tool or tool support is explained further below in connexion with FIG. 12.

After completion of a cutting cycle of the kind described, the machine is moved together with the tool arms into a new starting position according to the illustration, as shown by the solid lines in FIGS. 1 and 3, and respectively FIGS. 4 and 5. The necessary forward movement can be carried out in each case using the units 2 by moving the inner body 3 and/or by moving the whole machine by means of the carriage 7 after releasing the gripper devices.

Figure 13:
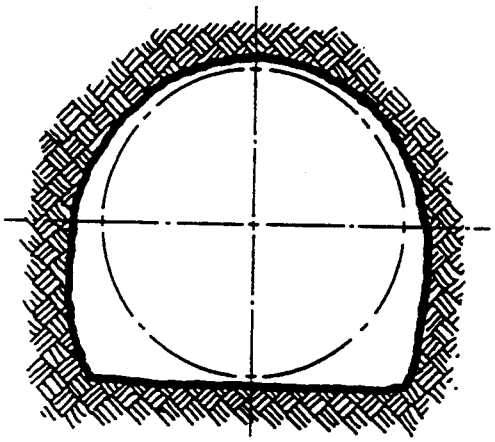
FIGS. 13 and 14, show two further examples of cross-sectional profiles which can be driven in accordance with this invention.
Figure 14:
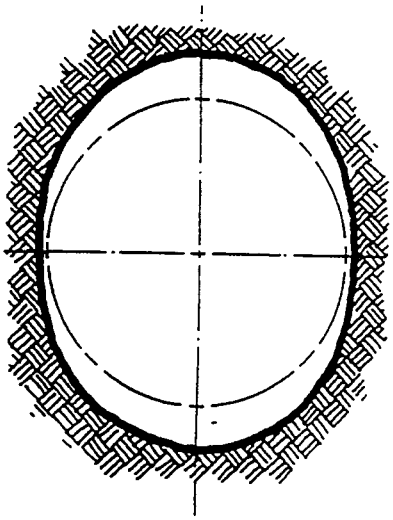

Apart from drifts, tunnels, stopes, caverns or the like with circular cross-sections or with approximately square or rectangular cross-sections, as the Figures explained so far show, numerous other profiles can be produced, with the method and the machine according to this invention. As an example, FIG. 13 shows a drift with an arcuate contour in the upper part and a flat floor, and FIG. 14 an elliptical profile, such as may be suitable for a canal for example. In addition, these two Figures show in broken lines the circular contours which have been produced initially according to the method described.

The tool arms 31, 32, 33 and the tool arm 51 can be located, as shown, on a single head 4. In another embodiment, the tool arms for cutting the central region and for cutting an outer region are mounted on separately driven heads. This is illustrated, for example, in FIG. 3 by broken lines on the head, in such a manner that the tool arm 51 for the central region is mounted on an inner head (4A) and the tool arms 31, 32, 33 for the outer region are mounted on an outer, annular head (4B), which is concentric to the head (4A). Both heads are rotatably mounted in a suitable manner and can be driven separately at selected speeds. Obviously, the construction and arrangement of the individual parts is suitably chosen as a modification of those shown in FIG. 3.

All or only some of the tool supports with the tools held therein can be mounted adjustably on the associated tool arms, either with a linear or with an angular adjustment mechanism. This applies both to tools for cutting the central region and to tools for cutting an outer region.

Figure 12:
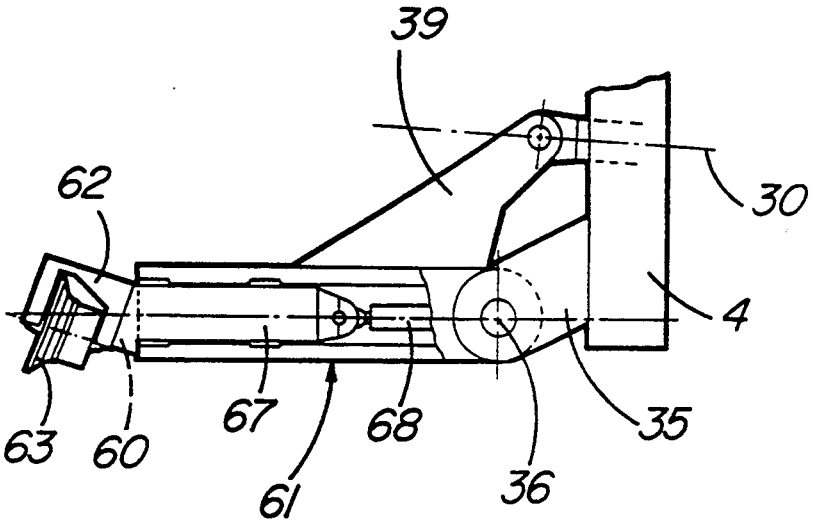
FIG. 12, shows a side view of an adjustable, telescopic tool arm.

As an example, FIG. 12 shows a telescopic arrangement of a tool arm 61. A slide member 67, which on its front end carries the associated tool support 62 with a disc cutter 63, is slid in a tubular main part of the tool arm 61. The outward or inward movement of the slide member 67 is effected by a cylinder-piston unit 68 accommodated in the tool arm. Instead of this, a threaded spindle or other suitable adjusting or moving device can be provided.

Angular adjustability of the tool support 62 can be provided in various ways. Thus the tool support 62 can be coupled or guided e.g. pivotably on the tool arm and can be fixable in a pre-set angular position. In another embodiment shown in broken lines in FIG. 12, a wedge 60 is provided as a spacer, which is pierced by screws not shown, with which the tool support 62 is fixed to the slide member 67. By changing the wedge 60 for one with a different slope, the angular position of the tool support 62 can be varied.

Angular adjustment of a tool support can be provided which, unlike the arrangement shown in FIG. 12, has no linear adjustment; also only longitudinal adjustment can be provided.

All features mentioned in the above description or shown in the drawings are intended, as far as the known state of the art permits, to be considered as falling within the scope of the present invention either individually or in combination.

We claim:

1. Method for excavating drifts, tunnels, stopes, caverns or the like, with tools capable of operating in an undercutting manner on a rock face, mounted on tool arms, said tool arms being mounted on a head rotating about a reference axis, in the direction of excavation, so as to pivot radially relative to said reference axis, comprising cutting in an undercutting manner, with at least one tool on a tool arm, a central region of the rock face by pivoting said tool arm radially from the outside inwards, and cutting, also in an undercutting manner, with at least one other tool on another tool arm, an outer region surrounding the central region of the rock face by pivoting said other tool arm radially from the inside outwards.

2. Method according to claim 1, comprising bringing substantially simultaneously said at least one tool for cutting the central region of the rock face and said at least one other tool for cutting the outer region of the rock face into contact with the rock face and pivoting the tool arm of said at least one tool for cutting the central region of the rock face and the tool arm of said at least one other tool for cutting the outer region of the rock face in opposite directions relative to the reference axis.

3. Method according to claim 1, comprising bringing said at least one tool for cutting the central region of the rock face and said at least one other tool for cutting the outer region of the rock face into contact with the rock face at substantially the same radial distance from the reference axis and pivoting the tool arm of said at least one tool for cutting the central region of the rock face and the tool arm of said at least one other tool for cutting the outer region of the rock face in opposite directions relative to the reference axis.

4. Method according to claim 1, comprising using a ratio of the number of tools working in the central region Of the rock face to the number of tools working in the outer region of the rock face that corresponds approximately to the ratio of radial extension of the central region of the rock face to maximum radial extension of the outer region of the rock face surrounding the central region.

5. Method according to claim 1, comprising, when cutting a non-circular profile, at first, when at least part of the central region of the rock face is being cut, together with an outer region of the rock face surrounding the central region, cutting a substantially circular cross-sectional outline, and subsequently cutting a cross sectional profile deviating from the circular.

6. Machine for excavating drifts, tunnels, stopes, caverns or the like having a head which is rotatable and movable in the direction of excavation, on which head tool arms are mounted which are radially pivotable by drives relative to a reference axis forming the axis of rotation of the head, the tool arms having tool supports for tools, operating in an undercutting manner, wherein for cutting an outer region of the rock face surrounding a central region, at least one tool arm is pivotable from a starting position in which the tool is located on an engagement point lying between the reference axis and the outer circumference of the rock face, outwards to a position in which its tool is located at the outer circumference of the rock face, characterised in that: for cutting a central region (Z) of the rock face (B) in an undercutting manner, at least one tool arm (51) is pivotable from a starting position, in which its tool (54) is located on an engagement point (E2) lying between the reference axis (M) and the outer circumference of the rock face (B) , inwards to a final position, in which its tool (54) is located on or near the reference axis (M).

7. Machine according to claim 6, characterised in that for cutting an outer region (A) of the rock face (B) an odd number of tool arms (31, 32, 33) is provided.

8. Machine according to claim 7, characterised in that for cutting a central region (Z) of the rock face (B) one tool arm (51), and for cutting an outer region (A) of the rock face (B) three tool arms (31, 32, 33) are provided.

9. Machine according to claim 6, characterised in that the pivotal axis (56) of at least one tool arm (51) with a tool (54) for cutting the central region (Z) of the rock face (B) is positioned on or near the reference axis (M), on either side of said reference axis.

10. Machine according to claim 6, characterised in that at least one tool arm (51) for cutting the central region (Z) of the rock face (B) and at least one tool arm (31, 32, 33) for cutting an outer region (A) of the rock face (B) are mounted on separate heads (4A, 4B) rotatable about a common axis.

11. Machine according to one of claim 6, characterised by hydraulic or pneumatic devices (30, 50) as drives for the tool arms (31, 32, 33, 51).

12. Machine according to claim 11, characterised in that the drives (50 and 30 respectively) for the tool arm or arms (51) for cutting the central region (Z) of the rock face (B) and for the tool arm or arms (31, 32, 33) for cutting an outer region (A) of the rock face (B) are controllable independently of one another.

13. Machine according to claim 11, characterised in that the drives (30) for the tool arms (31, 32, 33) for cutting the outer region (A) of the rock face (B) are controllable to cut cross-sections with noncircular contours.

14. Machine according to claim 11, characterised in that the drives (30, 50) for moving tool arms (31, 32, 33, 51) are controllable according to a predetermined program.

15. Machine according to claim 6, characterised in that tool supports (41, 42, 43, 52, 62) are mounted adjustably on the tool arms (31, 32, 33, 51, 61).

16. Machine according to claim 15, characterised by the tool supports (62) which are mounted displaceably on the associated tool arms (61).

17. Machine according to claim 16, characterised in that at least one tool arm (61) has a telescopically extensible part (67) with the tool support (62) mounted at its end.

18. Machine according to claim 15, characterised by the tool supports (41, 42, 43, 52, 62) whose angle relative to the associated tool arms (31, 32, 33, 51, 61 ) is adjustable.

19. Machine according to claim 6 characterised in that said machine has a part (1) fixable in the excavated drift (S) and a part (3) with the head (4) or heads (4A, 4B) displaceable relative to said fixable part (1).

20. Machine according to claim 6, characterised in that said machine has means for advancing or retracting the head (4) of the machine or the entire machine.

21. Machine according to claim 6, characterised in that said machine comprises muck removing devices (27, 28) for collecting and transporting away the muck.

22. Machine according to claim 6, wherein said tools operating in an undercutting manner consist of disc cutters.

* * * * *